US005219233A

United States Patent [19]

Bäuerle et al.

[11] Patent Number: 5,219,233

[45] Date of Patent: Jun. 15, 1993

[54] PROCESS FOR CONTROLLING THE OPERATION OF A PRINT HEAD

[75] Inventors: Ralph Bäuerle, Berlin; Dietmar Kottwitz, Singapur; Michael Blume; Joachim Schwarzkopf, both of Berlin, all of Fed. Rep. of Germany

[73] Assignee: Siemens Nixdorf Informationssysteme AG, Paderborn, Fed. Rep. of Germany

[21] Appl. No.: 730,875

[22] PCT Filed: Jan. 10, 1990

[86] PCT No.: PCT/EP90/00056

§ 371 Date: Sep. 11, 1991

§ 102(e) Date: Sep. 11, 1991

[87] PCT Pub. No.: WO90/08039

PCT Pub. Date: Jul. 26, 1990

[30] Foreign Application Priority Data

Jan. 12, 1989 [DE] Fed. Rep. of Germany ..... 3900765

[51] Int. Cl.[5] ..... B41J 2/23

[52] U.S. Cl. ..... 400/74; 400/54; 400/124; 400/279; 400/322

[58] Field of Search ..... 400/54, 279, 124, 74, 400/320, 322

[56] References Cited

U.S. PATENT DOCUMENTS

| | | | |
|---|---|---|---|
| 4,091,913 | 5/1978 | Ku et al. | 400/124 |
| 4,579,467 | 4/1986 | Furukawa | 400/124 |
| 4,877,343 | 10/1989 | Hori | 400/124 X |

FOREIGN PATENT DOCUMENTS

| | | | |
|---|---|---|---|
| 2517766 | 10/1976 | Fed. Rep. of Germany | 400/124 |
| 0079189 | 6/1980 | Japan | 400/322 |
| 0060287 | 5/1981 | Japan | 400/279 |
| 0055256 | 4/1983 | Japan | 400/124 |
| 0199962 | 9/1986 | Japan | 400/54 |
| 0080274 | 3/1990 | Japan | 400/322 |
| 0009854 | 1/1991 | Japan | 400/54 |

*Primary Examiner*—Edgar S. Burr
*Assistant Examiner*—Christopher A. Bennett
*Attorney, Agent, or Firm*—Dykema Gossett

[57] ABSTRACT

A process for controlling the operation of a printing head detects defects in the transport of the printing head along a printed line and if necessary corrects them. A control unit (24) controls a current source (16) which supplies current to a transport motor (12) which moves the printing head (10). The printing elements (14) of the printing head (10) are supplied with pulsed drive current (ID) by a driver component (18). A position indicator (20) records the distance travelled by the printing head (10) along a printed line. According to the invention, the transport time between two printing positions is monitored to detect whether a limit value (G) is exceeded. If the limit value (G) is exceeded, the drive of the printing head (10) is stopped and if necessary the printing head is moved in the opposite direction and/or at least one printing element (14, 15) is operated with less energy that that required for printing. As a result of these measures, a defect due to adhesion of a printing element (14) to a printing ribbon can be detected and eliminated automatically.

16 Claims, 3 Drawing Sheets

PROCESS FOR CONTROLLING THE OPERATION OF A PRINT HEAD

BACKGROUND OF THE INVENTION

1. Technical Field

This invention concerns a process for controlling the operation of a print head that is moved from the printing position in a given direction and within a given transport time to another position after printing a character by actuation of at least one printing element, whereby the transport time is monitored to determine whether a limit value is exceeded, and if the limit value is exceeded, the drive of the print head is interrupted.

2. Background Art

Processes of this type are used in printers for printing text, data or graphic information. They are used to bring a print head into a given printing position and then produce an impression on a substrate such as paper by actuation of at least one printing element. To do so, an ink ribbon is arranged between the print head and the substrate and comes in contact with the substrate when the printing element is actuated. With a number of printers, the information to be printed is printed character by character, i.e., the print head is shifted in the direction of the line and in doing so executes the printing operation.

After printing a line, the printed substrate is advanced by the distance equal to one line by means of a roller, for example, and then the line-by-line printing operation is carried out again. During printing, the instantaneous position of the print head in a line is detected and can be relayed by means of a position-reporting signal to a controller that actuates a printing element to print a character on reaching a certain position. This principle can be used in an interval-controlled operation, whereby the movement of the print head is interrupted and then the printing element is actuated, and it can also be used in so-called "flying" printing. In the latter case, the print head is not stationary when printing a character but instead the printing element is actuated without interrupting the movement of the print head along the line.

In operation of a print head, the print head may adhere to the printing medium, i.e., the ink ribbon or the substrate, after actuating a printing element. For example, with a needle print head, whose printing elements are needles, a needle actuated for printing can puncture the ink ribbon and hook into it so that it does not return to its resting position. When the print head is advanced to the next printing position, the needle can be either bent or broken off due to the relative motion between the needle and the ink ribbon. This causes destruction of the entire print head. This risk is increased with recent needle printers due to the fact that the number of needles per print head is high and thin needles that can more easily puncture the ink ribbon are used. Even with printing processes that do not use an ink ribbon but use so-called active paper as the substrate, it is still possible for a printing element to penetrate into the substrate and adhere to it by hooking into it.

In other printing processes, it is also possible for the print head and ink ribbon to stick together. For example, in heat transfer printing, where the printing elements are electric heating resistors that transfer the character to the printing stock with the help of a melting ink ribbon, there is the danger that the printing element of the print head might stick to the melting tool adhering to the ink ribbon. The ink ribbon, which is made of a plastic film, may also adhere to the printing elements due to overheating or because of surface defects, which thus can cause interference in operation of the print head.

In addition, interference can also occur in transport of the print head due to an incorrectly inserted printing stock, due to a paper jam or due to trouble in the drive system. In all these cases, it would be desirable to be able to detect these problems promptly in order to prevent damage to sensitive components.

SUMMARY OF THE INVENTION

Therefore, the goal of this invention is to develop a process for controlling operation of a print head whereby transport problems will be detected and eliminated if possible.

This problem is solved for a process of the aforementioned type by the fact that in order to release sticking between the printing element and a printing medium, the print head is moved in the direction opposite the given direction whenever the limit value is exceeded and/or at least one printing element is operated with reduced power in comparison with the power applied for printing.

This invention makes use of the finding that due to the sticking of the print head and the printing medium, i.e., the ink ribbon or the printing stock, the forward movement of the print head is prevented by the ink ribbon or the printing stock and it does not reach the next printing position or reaches it with a delay. By monitoring the transport time, it is possible to detect trouble in transport of the print head and interrupt the drive of the print head. This prevents damage to the print head and measures can be initiated to eliminate the transport problem. It is advantageous to use the position signal of the printer, which is a known feature, for achieving the specified printing positions.

This invention provides for the print head to be moved in the direction opposite the given direction whenever the limit value is exceeded. This simple measure makes it possible to release any sticking of the print head and printing medium. For example, when a needle punctures the ink ribbon in a needle print head and the ink ribbon is thus stretched when the print head continues to move, the elastic tension between the needle and ink ribbon is reduced due to the reverse movement of the print head to the extent that the needle resiliency which retracts the needle into a resting position in the print head is sufficient to release it from the ink ribbon.

Another possibility of eliminating the sticking of the print head and ink ribbon consists of actuating one or more printing elements, whereby the energy required for this is reduced in comparison with the energy used to print a character. By actuating the printing element, the result achieved is that energy that results in release of the two parts is supplied at the location where the ink ribbon and print head are sticking together. For example, with a heat transfer printer, the adhesive bond between the print head and the melting ink ribbon is softened as heat is applied and thus is released. With a needle printer, mechanical energy is applied at the location where the needle is caught in the ink ribbon by actuating one or more printing elements. The tensile and compressive forces which thus occur at the point of contact together with the resiliency of the needle cause the needle to be released from the ink ribbon and returned to its resting position.

Preferably a combination of he aforementioned measures can also be used. This can occur by actuating the printing element during or after the reverse movement of the print head. The two work together in such a way that adherence of the print head and the ink ribbon can be eliminated with a high degree of reliability.

In a process according to this invention, the limit value for which the time between printing a character and output of the position reporting signal is monitored is preferably set according to the type of print head or printing parameters. Such printing parameters include, for example, the speed at which the printing head moves, the type of ink ribbon or the energy that must be expended to actuate the printing element. As a result of these measures, it is possible to use the principle according to this invention for a large number of types of print heads and for different printers with several modes of operation.

In a practical refinement of this invention, the reduced energy needed to actuate the printing element is such that no character is printed. As a result, the measures for eliminating the trouble due to the sticking of the ink ribbon and the print head do not leave any traces on the printing stock. The quality of the printed result is thus not affected by these measures.

An advantageous refinement of this invention is also possible due to the fact that one or more printing elements are actuated with reduced energy repeatedly in succession. When this measure is used with needle printers, for example, it leads to a vibrating motion between the needle and the ink ribbon. This type of motion facilitates the release of a needle caught in the ink ribbon.

Another advantageous refinement of this invention may also be implemented in such a way that the printing elements of the print head are actuated simultaneously with reduced power. What this means for a needle print head is that all needles are deflected simultaneously and press against the ink ribbon. In this way the ink ribbon is shifted in the direction of the printing stock and is stripped away from the needle caught in it.

Preferably with a needle print head, the energy required to operate the print element is such that the needle stroke is reduced approximately by one-half. In practice, it has been found that with this stroking motion of the needle or several needles, an optimum result is achieved in releasing the needles sticking to the ink ribbon on the one hand and on the other hand there is great security in the fact that no character will be printed on the printing stock.

Another refinement of this invention is characterized in that a transport motor provided for moving the print head is short-circuited or is driven with a countercurrent when the limit value is exceeded. This measure causes the motor to be electrically decelerated and the movement of the print head stops after a very short distance. In doing so, the ink ribbon and the printing element of the print head are not subjected to a stress that exceeds their limit of elasticity, i.e., they are not damaged. Furthermore, the total time needed to eliminate the problem is shortened by this measure.

The process according to this invention can also be carried out in such a way that a transport motor that is provided for moving the print head is driven with a predetermined number of current pulses to move it in the opposite direction. These cause a jerky stepwise movement of the printing head so sudden tensile and compressive forces occur at the point of contact between the print head and the ink ribbon. These forces facilitate the release of the adhesive bond between the print head and the ink ribbon. The number of current pulses is adjusted according to the type of transport motor, the printer, the ink ribbon and other pressure-specific parameters.

Another practical implementation of this invention provides for the print head to be positioned after a predetermined period of time on the printing position which it held before the limit value was exceeded and then printing is continued in this position. The predetermined time is set according to the type of print head, the transport motor and other parameters. This design assures almost interruption-free operation of the printer. However, if such trouble recurs within a certain period of time, an error report can be generated when the limit value is exceeded a predetermined number of times in another variant of this invention. This makes it possible to indicate trouble that cannot be eliminated by the process according to this invention so that other measures such as repair or replacement of the print head can be taken.

In another expedient version of this invention, such a measure may consist of the fact that operation of the print head is stopped when the limit value is exceeded several times within a given period of time.

In an advantageous refinement of the process according to this invention, the direction of movement of the print head is determined whenever there is an interruption in operation because the limit value has been exceeded, and if there is a failure in reversal of directions, another error report is generated. As a result of this measure, errors that are manifested by exceeding the limit value and cannot be attributed to sticking of a printing element can be detected reliably. When a printing element sticks to the ink ribbon or the printing stock, an elastic tension occurs and results in a resilient force and thus causes a reversal in the direction of the print head. For example, after a print needle has been hooked in the ink ribbon, a needle print head stretches the ink ribbon by a certain amount due to the energy of movement of the print head so the resulting resilient force causes the print head to swing backwards. This reversal in direction can be detected by means of the position-reporting signal, for example. If this reversal of direction does not occur, then there is trouble that might be caused, for example, by mechanical jamming of the print head or by a paper jam. Consequently, an error report can be generated or operation of the print head can be interrupted.

One practical example of this invention is illustrated below with reference to the figures which show the following.

DETAILED DESCRIPTION OF THE PREFERRED EMBODIMENT

Figure 1:
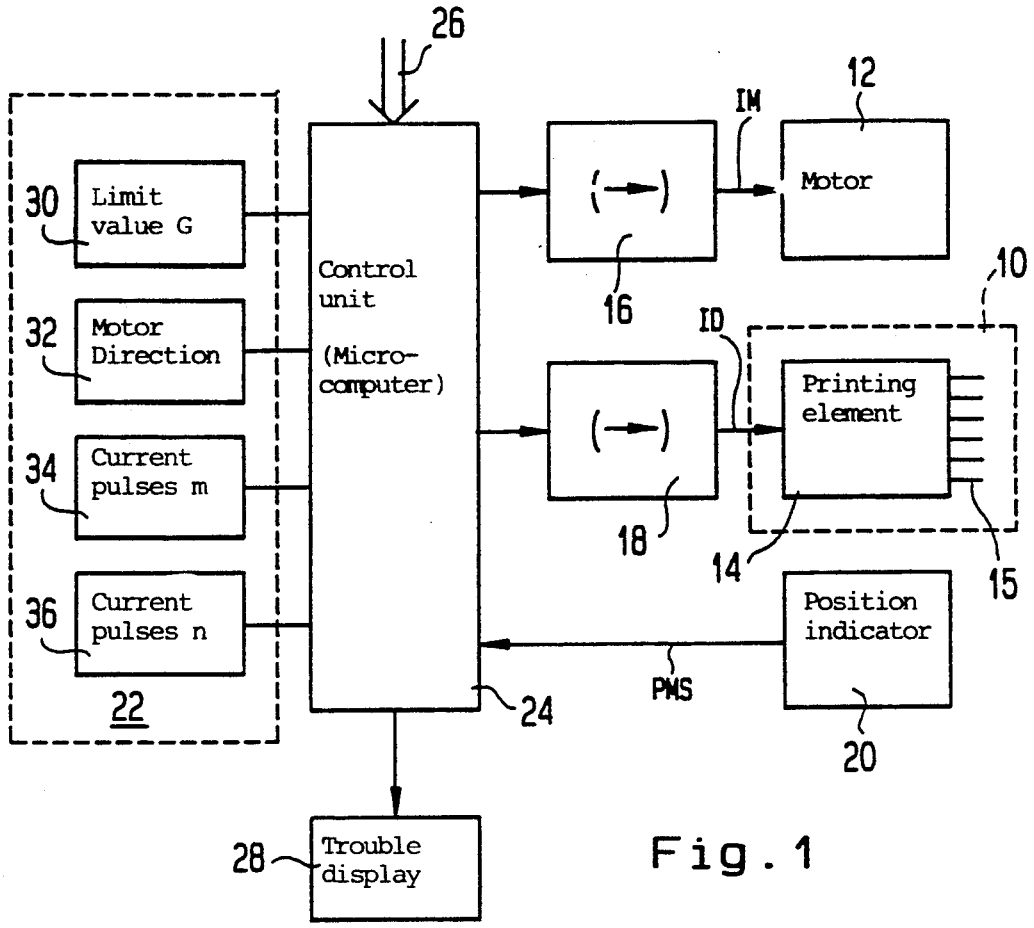
FIG. 1 shows the basic design of a controller in a block diagram for operation of a print head.

FIG. 1 shows various functional units of a controller in a printer for operation of a needle print head 10 which is moved back and forth along a line of print by a transport motor 12. Transport motor 12 is supplied with motor current IM from a power source 16. Needle print head 12 has as its printing elements needles 14 that are arranged in the form of columns or a matrix in print head 10 and the number of needles will be 7, 9, 12 or more depending on the type of print head. A needle 15 is shown separately and will be discussed in detail later in describing a trouble incident. Needles 14 are actuated in printing by an electromagnetic actuating mechanism, whereby they are deflected from their resting position in print head 10 and are pressed against an ink ribbon that transfers a character to printing stock. The electromechanical actuating elements (not shown in FIG. 1) are supplied with a driving current ID in the form of pulses from a driver component 18, where the electric energy can be varied by varying the period and amplitude of the current pulses.

The path covered by print head 10 along a line of print is detected by a position indicator 20 which may be a conventional path coder that generates two signals that are shifted in phase by 90° at given intervals. On the basis of these signals, the path covered by print head 10 can be determined by counting the coding pulses and its direction of movement can be determined by comparison of the phase position of the signals. Position indicator 20 thus sends a position reporting signal PMS to control unit 24. This signal contains information regarding the instantaneous position of print head 10 as well as its direction of movement.

To perform the printing operation, the control unit 24 receives additional control information by way of data line 26. Such information may include, for example, the character to be printed, the printing speed, the start and end of a printing process. Using all this information, control unit 24 generates control signals that are then sent to the power source 16 and to the driver component 18 so the movement of transport motor 12 and the printing of characters are controlled. Control unit 24 contains a microcomputer for carrying out its various functions. This microcomputer is equipped with a program memory and data memory as well as a clock unit. This type of control of a needle print head is essentially known and therefore the details need not be explained.

To carry out the process according to this invention, control unit 24 has access to other control modules 30 to 36 that are contained as software programs in a read-only memory 22 (ROM). These control modules include a monitoring module 30 that monitors the time between actuation of a print element 14 by a driver current pulse ID and the occurrence of a position reporting signal PMS to determine whether they exceed limit value G. Control module 32 controls the direction of rotation of transport motor 12 in the event of trouble. Control module 34 is provided in order to generate a given number m of motor current pulses that are delivered to transport motor 12 which then converts them to stepping movements. Finally, control module 36 generates a given number n of pulses that act indirectly by way of driver module 18 in order to actuate printing elements 14. Furthermore, control unit 24 has a trouble display 28 which is triggered in the event of trouble and provides notice of any errors in operation.

Figure 2:
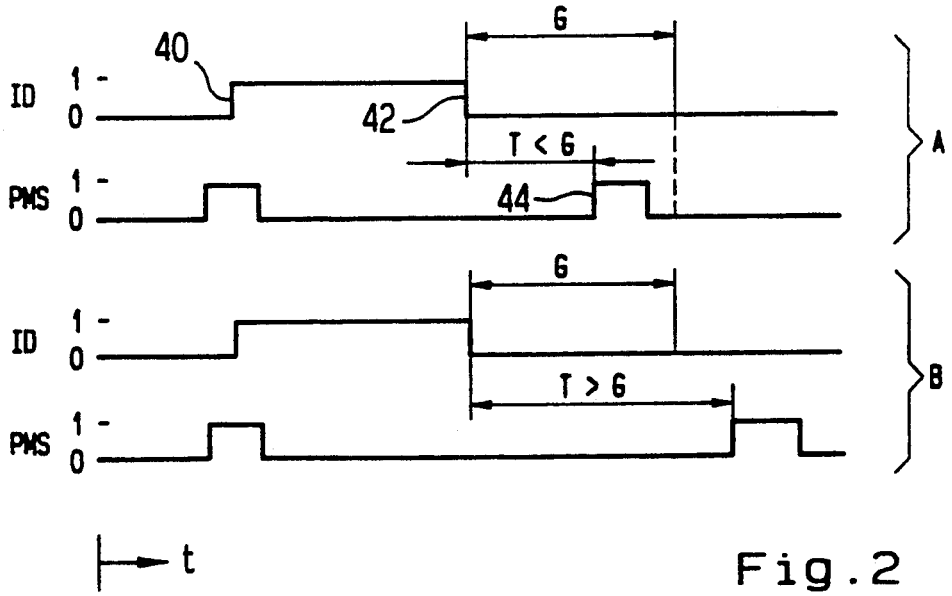
FIG. 2 shows the signal plots of the driving current for actuation of a print element as well as the position reporting signal as a function of time.

FIG. 2 shows signal plots of the position-reporting signal PMS as a function of the driver current ID. The signal states are labeled as logic 1 and logic 0 and indicate current flow and a state of rest, respectively. The signal plots differ in normal operation A and in the trouble case B. In normal operation A, print head 10 is advanced along a line and one or more needles 14 are actuated in so-called "flying" printing. Printing processes are described below on the basis of needles 15 which are illustrated separately in FIG. 1. The ink ribbon is stretched along a line with the type of printer described here and is not moved back and forth with the print head. With the rising edge 40 in driver current ID, needle 15 is deflected in the direction of the ink ribbon with a slight delay which is due to the inertia of the electromechanical actuating element. The ink ribbon, which is made of a fabric-like material, is pressed against the printing stock by the tip of needle 15, so it forms a dot-shaped character on the printing stock. When several needles are actuated in this way, a columnar or mosaic-like print character is formed on the printing stock. After actuating needle 15, it is normally retracted by its resilient force into its resting position in needle print head 10.

With the descending edge 42 of the driver current, the monitoring module 30 becomes active and monitors the time T until occurrence of the next position-reporting signal PMS when the given limit value G is exceeded. This limit value is set according to print-specific parameters such as the type of print head and the printing speed. In normal operation A, the time T is smaller than limit value G, which means that the printing operation proceeds normally.

In case B, printing operation is interrupted, i.e., print head 10 does not reach the next position signaled by a square wave pulse of position-reporting signal PMS within the specified period of time after the drop in driver current ID. For example, a paper jam or improperly inserted paper may prevent the forward motion of print head 10. In general, such trouble can be eliminated only by an operating person. Another problem that often occurs is due to the fact that one of needles 14, e.g., needle 15, punctures the fabric of the ink ribbon when executing its back-and-forth motion and thus sticks in the ink ribbon. The ink ribbon thus held up then inhibits the motion of print head 10 so time T to reach the next position exceeds limit value G. Such a problem is thus reliably detected by the time monitoring function. This problem is automatically eliminated by the process steps according to this invention as explained below.

Figure 3:
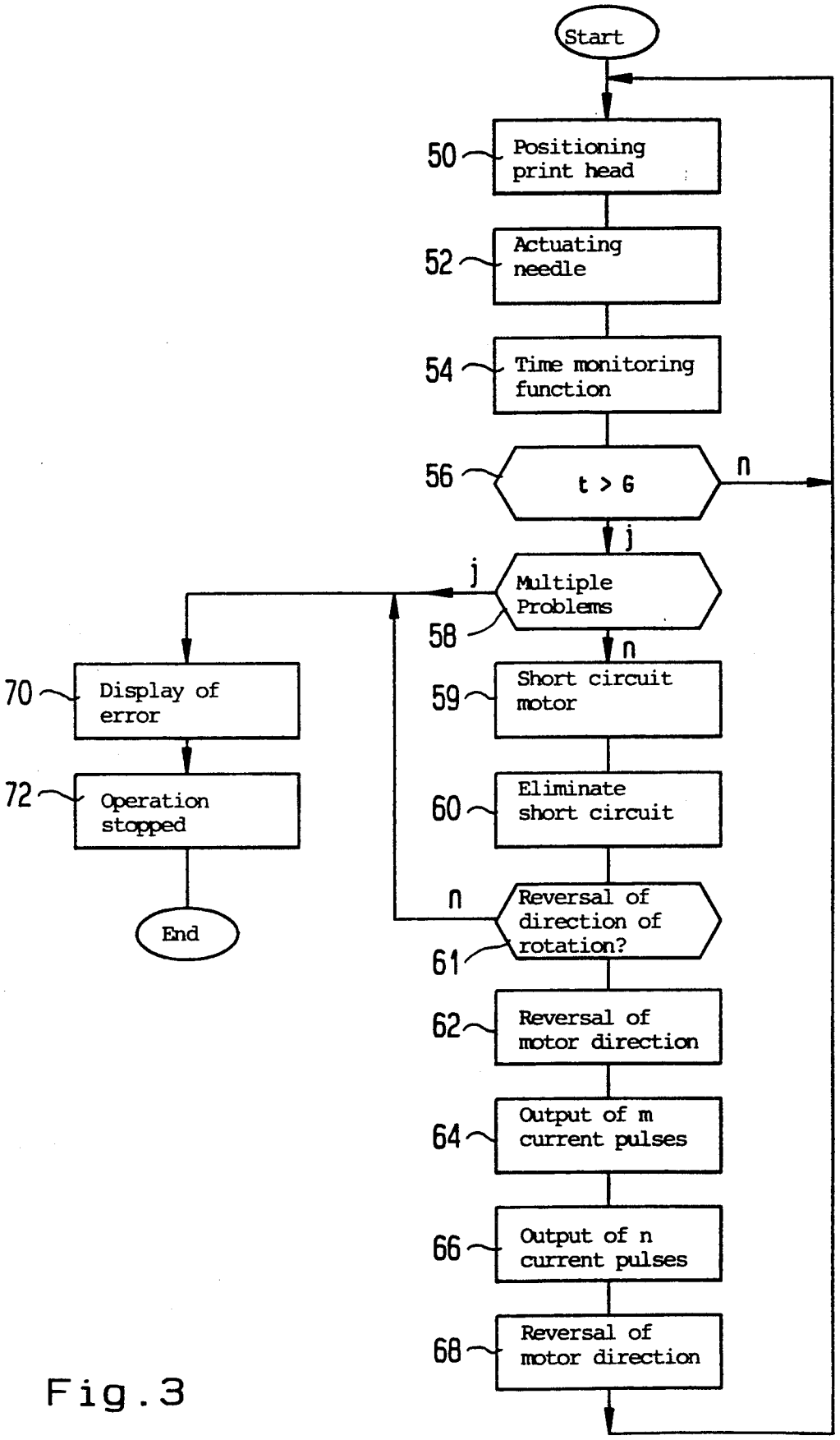
FIG. 3 shows a logic flow chart of process steps.

The control functions of control unit 24 that take place in normal operation and in the event of trouble are illustrated in FIG. 3 in the form of a flow chart. In a first step 50, as described above, print head 10 is moved along the line by the transport motor 12 and its instantaneous position is determined on the basis of the position-reporting signal PMS by counting pulse edges. To print a character in a given position (step 52), the needles forming the character are selected from printing elements 14 and the corresponding electromechanical actuating elements are driven with driver current ID. In the next step 54 on the descending edge of the driver current ID, a time monitoring function is active and determines whether the pulse edge of the position-reporting signal PMS occurs within the limit value time G (step 56). The time monitoring function is accomplished with the help of a counting module that is loaded with an initial count that is proportional to limit value G. When starting the time monitoring function, the count is decremented according to the cycle of a clock signal provided by the clock unit of the microcomputer. If a position-reporting signal PMS occurs before reaching count 0, then this is a normal printing operation and step 50 is initiated in order to continue the printing process. If so much time elapses until occurrence of the position-reporting signal PMS that the count 0 is reached then the next step is step 58, where an inquiry is made as to multiple problems, the importance of which will be explained below. If there are no multiple problems, then transport motor 12 is stopped in the next step 59 in order to interrupt the movement of print head 10. This is done by short-circuiting the motor winding of the transport motor 12 so a great delay is initiated by the eddy current effect. It would also be conceivable to drive the motor winding with a polarity opposite that of the current so the delay would be further increased. A long delay is desirable in order to compensate as much as possible for the prevailing energy of motion of print head 10 by transport motor 12 so the danger of tearing the ink ribbon or of bending of needles 15 is reduced.

In the next step 60, the braking effect is stopped. The ink ribbon, which is under elastic tension due to the printing needle being hooked in it, can then be released and then entrains the print head in the direction of stress relief, which is reported by a position indicator 20 as a reversal in the direction of motion. In step 61, the reversal of directions is analyzed. If the reversal of directions does not occur, then there is a problem such as a break in the drive connection between the motor and the print head or a paper jam. Then step 70 can be implemented directly, whereby an error report is generated. When there is a reversal of directions, the rotational direction of the motor is reversed in step 62, i.e., the direction of motion of print head 10 is then opposite the direction before the problem. Next the motor winding is driven with a given number m of current pulses IM (step 64), so print head 10 executes jerky stepping motions that cause or facilitate the release of needle 15 from the ink ribbon. The number m of current pulses IM as well as their amplitude and period are set so that print head 10 will return approximately to the position it held before the problem. As the next measure 66 all needles 14 of print head 10 are actuated. To do so, n current pulses of a defined width are generated by driver module 18 as the driver current ID and sent to the electromechanical actuating elements of needles 14. The energy supplied to the actuating elements is adjusted by varying the pulse period in such a way that needles 14 execute approximately half of their back-and-forth motion. With this movement, needles 14 are pressed against the ink ribbon and strip it away from the needle 15 stuck in it. Due to this reduced back-and-forth motion, printing of a character on the printing stock is prevented. In addition, a vibrating motion that facilitates the release of needles 15 from the ink ribbon is induced by the repeated actuation of needles 14. Actuation of needles 14 can be carried out before or during the braking of transport motor 12 and also during the jerky reverse movement of print head 10. If the printing elements 14 are not actuated until after the reverse movement of print head 10, this has the advantage that the ink ribbon is released of tension so that no transverse forces are exerted on the needle 15 caught in the ink ribbon.

In the subsequent step 68, the direction of rotation of transport motor 12 is reversed again so the direction of movement of print head 10 is the same as its direction before the interruption. After a waiting time, step 50 is initiated in order to automatically continue the printing at the point of interruption.

As explained above, an inquiry as to multiple problems is made in step 58. This is done in order to detect multiple occurrence of an interruption or a delay in motion of the print head. Such successive problems can be caused, for example, by a paper jam, a defective ink ribbon or a needle that is hooked very strongly into the ink ribbon. If such problems occur repeatedly within a given period of time, then step 70 is initiated after a given number of attempts to release the needle and an error report is generated and displayed. The operator of the printer can then perform the maintenance or repair of the printer. Of course such an error report can also be generated as soon as a single problem occurs, in which case it is then possible to perform a statistical analysis of the errors. After display of the multiple trouble signal, operation of the print head is interrupted in the present example (step 72).

Figure 4:
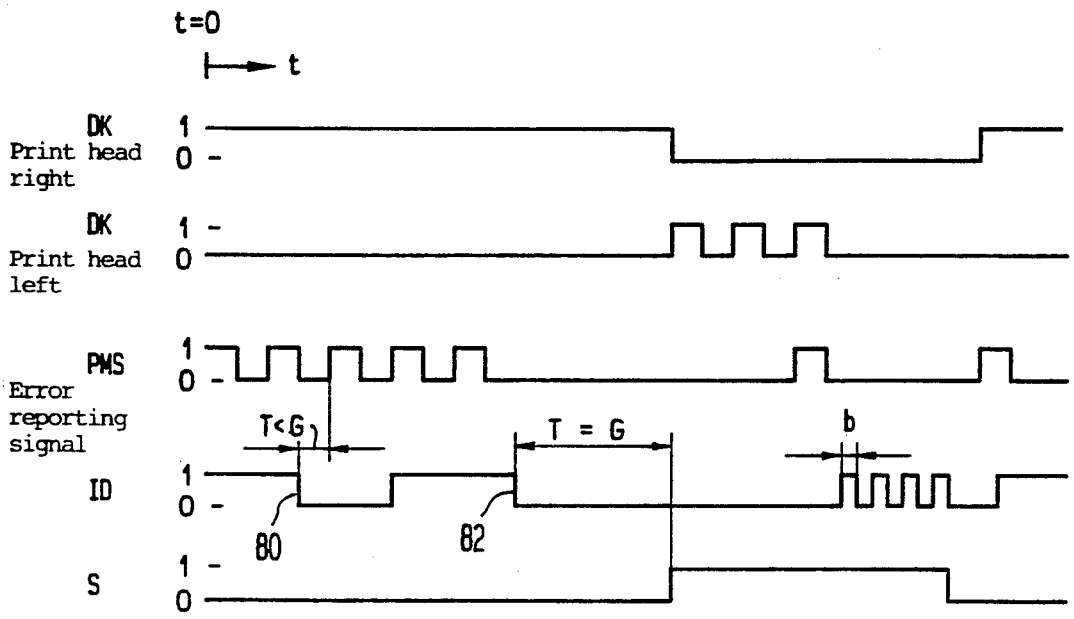
FIG. 4 shows conditions and signal plots in normal operation and when there is trouble.

FIG. 4 illustrates various states in operation of print head 10 as a function of time t. The plots of the direction of movement of print head 10 (print head right, print head left), of the position-reporting signal PMS, of the driver current ID for actuation of print elements 14 and of the trouble state S are shown as a function of time. At time t=0, print head 10 moves from left to right in the direction of the line. The path covered by it is signaled by the position-reporting signal PMS in the form of square wave pulses. A driver current ID is flowing which means that printing element 15 is being actuated and a character is being printed. On the descending edge 80 of driver current ID, the time monitoring function is actuated and the time T until occurrence of the rising edge of the pulse of the position-reporting signal PMS is measured. If this time is smaller than limit value G, then no problem S is indicated whereupon the time monitoring function is reset to the initial state and started again with the next descending edge 82 of driver current ID. In the case that time T reaches limit value G, a problem S is indicated. Then the measures for releasing a needle that might be stuck in the ink ribbon are initiated, i.e., transport motor 12 is stopped and moved step by step toward the left in the opposite direction. Then all needles 14 are driven with a fixed number of driver current pulses ID, where the pulse width b is reduced in comparison with that in normal operation of a printing element. After multiple operation of printing elements 14, the problem S will generally have been eliminated and print head 10 is moved back into its original direction and printing is continued.

We claim:

1. A process for controlling the operation of a print head, said print head having means for driving said print head and a plurality of printing elements for printing characters at one of a plurality of printing positions on a printing medium and within a transport time having a predetermined limit value, comprising the steps of:

(A) printing at least one said character at a first one of said printing positions on said printing medium by actuation of at least one of said printing elements;

(B) advancing said print head, using said driving means, in a predetermined direction from said first printing position to a second one of said printing position;

(C) interrupting said driving means if the transport time for the advancement of said print head in step (B) exceeds said limit value due to said printing element sticking to said printing medium; and (D) releasing said print head element from said printing medium by moving said print head in a direction opposite to the direction that said print head is advanced in step (B).

2. The process according to claim 1, wherein said limit value is set according to printing parameters of the print head.

3. The process according to claim 2, wherein said reduced energy has a value such that no character is printed on actuation of said printing element.

4. The process according to claim 2, wherein said printing elements of said print head are actuated simultaneously with said reduced energy.

5. The process according to claim 2, wherein said printing elements of said print head are actuated simultaneously with said reduced energy.

6. The process according to claim 2, wherein said printing element is of the needle type and the reduced energy for actuation of said printing element is such that the stroke of said printing element is reduced by about one-half.

7. The process according to claim 2, wherein said driving means includes a transport motor and step (C) is performed by:

stopping said transport motor when said limit value is exceeded.

8. The process according to claim 7 wherein stopping said transport motor is performed by short-circuiting said transport motor.

9. The process according to claim 7, wherein stopping said transport motor is performed by driving said transport motor with a countercurrent.

10. The process according to claim 2 wherein said driving means includes a transport motor provided for moving said print head in said opposite direction and wherein step (D) is performed by driving said transport motor with a predetermined number of current pulses.

11. The process according to claim 2, further comprising the step of generating a first error report when said limit value is exceeded a preselected number of times.

12. The process according to claim 2, further comprising the step of:

(E) switching of the operation of said print head within a predetermined period of time when said limit value is exceeded a preselected number of times.

13. The process according to claim 2, wherein step (B) is performed after step (C), and step (C) includes the substeps of:

determining said direction of movement of said print head; and generating a second error report if there is no reversal of direction.

14. The process according to claim 13, further comprising the step of:

interrupting the operation of said print head when there is no reversal of direction.

15. A process for controlling the operation of a print head, said print head having means for driving said print head and a plurality of printing elements for printing characters at each of a plurality of printing positions on a printing medium and within a transport time having a predetermined limit value, comprising the steps of:

(A) printing at least one of said characters at a first said printing position on said printing medium by actuating at least one of said printing elements;

(B) advancing said print head, using said driving means, in a predetermined direction from said first printing position to a second one of said printing position;

(C) interrupting said driving means if the transport time for the advancement of said print head in step (B) exceeds said limit value due to said printing element sticking to said printing medium; and (D) releasing said print head element from said printing medium by actuating said printing element with reduced energy.

16. The process according to claim 15, wherein step (D) is performed by repositioning said print head after said limit value is exceeded, at said first printing position where printing is continued.

* * * * *